US011535433B2

(12) United States Patent
McNamara et al.

(10) Patent No.: US 11,535,433 B2
(45) Date of Patent: Dec. 27, 2022

(54) CONTAINER CLOSURE WITH VENTING SEAL

(71) Applicant: Helen of Troy Limited, St. Michael (BB)

(72) Inventors: Conor McNamara, Montclair, NJ (US); Benjamin Robert Hein, Bend, OR (US); Shelley Palazzolo, Bend, OR (US); Adam Zagorsky, Portland, OR (US); Jarett Volkoff, Bend, OR (US)

(73) Assignee: Helen of Troy Limited, St. Michael (BB)

( * ) Notice: Subject to any disclaimer, the term of this patent is extended or adjusted under 35 U.S.C. 154(b) by 234 days.

(21) Appl. No.: 16/684,712

(22) Filed: Nov. 15, 2019

(65) Prior Publication Data

US 2021/0147125 A1 May 20, 2021

(51) Int. Cl.
*B65D 51/16* (2006.01)
*B65D 53/04* (2006.01)

(52) U.S. Cl.
CPC ..... *B65D 51/1622* (2013.01); *B65D 53/04* (2013.01)

(58) Field of Classification Search
CPC ..... B65D 51/1622; B65D 51/16; B65D 51/1644; B65D 53/02; B65D 41/0478; B65D 41/28; B65D 41/58; B65D 81/2046; B65D 51/1661; A61J 11/02; A61J 9/00; A61J 9/003; A61J 9/04
USPC ..... 215/243, 270, 248, 307
See application file for complete search history.

(56) References Cited

U.S. PATENT DOCUMENTS

| | | | | |
|---|---|---|---|---|
| 3,022,918 | A | 2/1962 | Smith | |
| 3,174,641 | A | 3/1963 | Kitterman | |
| 3,308,981 | A * | 3/1967 | Starr | B65D 41/0435 215/260 |
| 3,628,704 | A | 12/1971 | Corsette | |
| 4,036,386 | A | 7/1977 | Nishioka | |
| 4,685,580 | A | 8/1987 | Towns | |
| 7,588,142 | B1 * | 9/2009 | Bush | B65D 51/2857 206/221 |

(Continued)

FOREIGN PATENT DOCUMENTS

| | | |
|---|---|---|
| CN | 105966747 | 9/2016 |
| JP | 2013220173 | 10/2013 |

(Continued)

OTHER PUBLICATIONS

European Search Report issued in EP20206981 dated Mar. 26, 2021.

*Primary Examiner* — Anthony D Stashick
*Assistant Examiner* — Raven Collins
(74) *Attorney, Agent, or Firm* — Rankin, Hill & Clark LLP

(57) ABSTRACT

A container closure includes an outer cap, an inner cap, and a seal. The outer cap includes a top wall and an outer sidewall extending downward from the top wall. The inner cap is secured within the outer cap and includes a bottom wall and an inner sidewall extending upwardly from the bottom wall. The seal is secured to the inner cap and includes a seal sidewall and a rim extending inwardly from the seal sidewall. The seal sidewall sealingly engages the inner sidewall and the rim sealingly overlaps the bottom wall. The inner cap together with the seal define an air pathway in fluid communication between a space between the outer and inner caps and an air opening formed on the (Continued)

bottom wall of the inner cap and selectively covered by the rim.

18 Claims, 14 Drawing Sheets

(56) References Cited

U.S. PATENT DOCUMENTS

| | | | | |
|---|---|---|---|---|
| 7,909,192 | B2 | 3/2011 | Dempsey | |
| 8,430,259 | B2 | 4/2013 | Martinez | |
| 8,584,876 | B2 * | 11/2013 | de Cleir | B65D 41/045 215/310 |
| 8,875,927 | B2 | 11/2014 | Pohlman | |
| 9,944,440 | B2 | 4/2018 | Abraham | |
| 2011/0186536 | A1 | 8/2011 | Wurster | |
| 2018/0016066 | A1 | 1/2018 | Strachan | |
| 2019/0135505 | A1 * | 5/2019 | Cain | B65D 51/1611 |

FOREIGN PATENT DOCUMENTS

| | | | |
|---|---|---|---|
| JP | 2016147673 | 8/2016 | |
| JP | 2016169042 | 9/2016 | |
| WO | WO-2019085127 A1 * | 5/2019 | B65D 81/20 |

* cited by examiner

CONTAINER CLOSURE WITH VENTING SEAL

BACKGROUND

Liquid containers can become over or under pressurized and the container damaged depending on the liquid to be contained and the ambient temperatures. A known type of container closure is a cap having a non-gas tight screw thread for engaging with a complimentary threaded neck of the container and a seal in the cap to form a substantially gas and liquid-tight seal with the container neck. One solution for unwanted negative pressurization of the container is incorporate a gas vent in the seal and/or the cap for venting between the ambient atmosphere and the interior of the container through openings existing between the screw threads of the cap and threads of the container neck.

BRIEF DESCRIPTION

According to one aspect, a container closure comprises an outer cap, an inner cap, and a seal. The outer cap includes a top wall and an outer sidewall extending downward from the top wall. The inner cap is secured within the outer cap and includes a bottom wall and an inner sidewall extending upwardly from the bottom wall. The inner sidewall is offset from the outer sidewall to define a space between the outer cap and the inner cap for receiving an associated neck portion of an associated container. The seal is secured to the inner cap and includes a seal sidewall and a rim extending inwardly from the seal sidewall. The seal sidewall sealingly engages the inner sidewall and the rim sealingly overlaps the bottom wall. The inner cap together with the seal define an air pathway in fluid communication between the space between the outer and inner caps and an air opening formed on the bottom wall of the inner cap and selectively covered by the rim.

According to another aspect, a container assembly comprises a container including body portion and a neck portion having a mouth, and a container closure transitionable between an attached and a detached configuration with respect to the container neck portion. The container closure includes an outer cap, an inner cap, and a seal. The outer cap includes a top wall and an outer sidewall extending downward from the top wall. The inner cap is secured within the outer cap and includes a bottom wall and an inner sidewall extending upwardly from the bottom wall. The inner sidewall is offset from the outer sidewall to define a space between the outer cap and the inner cap for receiving the neck portion of the container. The seal forms a sealed connection between the neck portion and the closure when the closure is attached to the neck portion. The seal secured to the inner cap and includes a seal sidewall and a rim extending inwardly from the seal sidewall. The rim sealingly engages the bottom wall. The inner cap together with the seal define an air pathway in fluid communication between the space between the outer and inner caps and an air opening formed on the bottom wall of the inner cap and covered by the rim. The rim is configured to be lifted away from the bottom wall when a vacuum is formed within the container, allowing ambient air to flow through the air pathway and through the air opening into the container to equalize interior air pressure of the container and outside ambient air pressure.

DETAILED DESCRIPTION

It should, of course, be understood that the description and drawings herein are merely illustrative and that various modifications and changes can be made in the structures disclosed without departing from the present disclosure. For purposes of description herein, spatially relative terms, such as "upper" and "lower" and the like, may be used to describe an element and/or feature's relationship to another element(s) and/or feature(s) as, for example, illustrated in the figures of the present disclosure.

Figure 1:
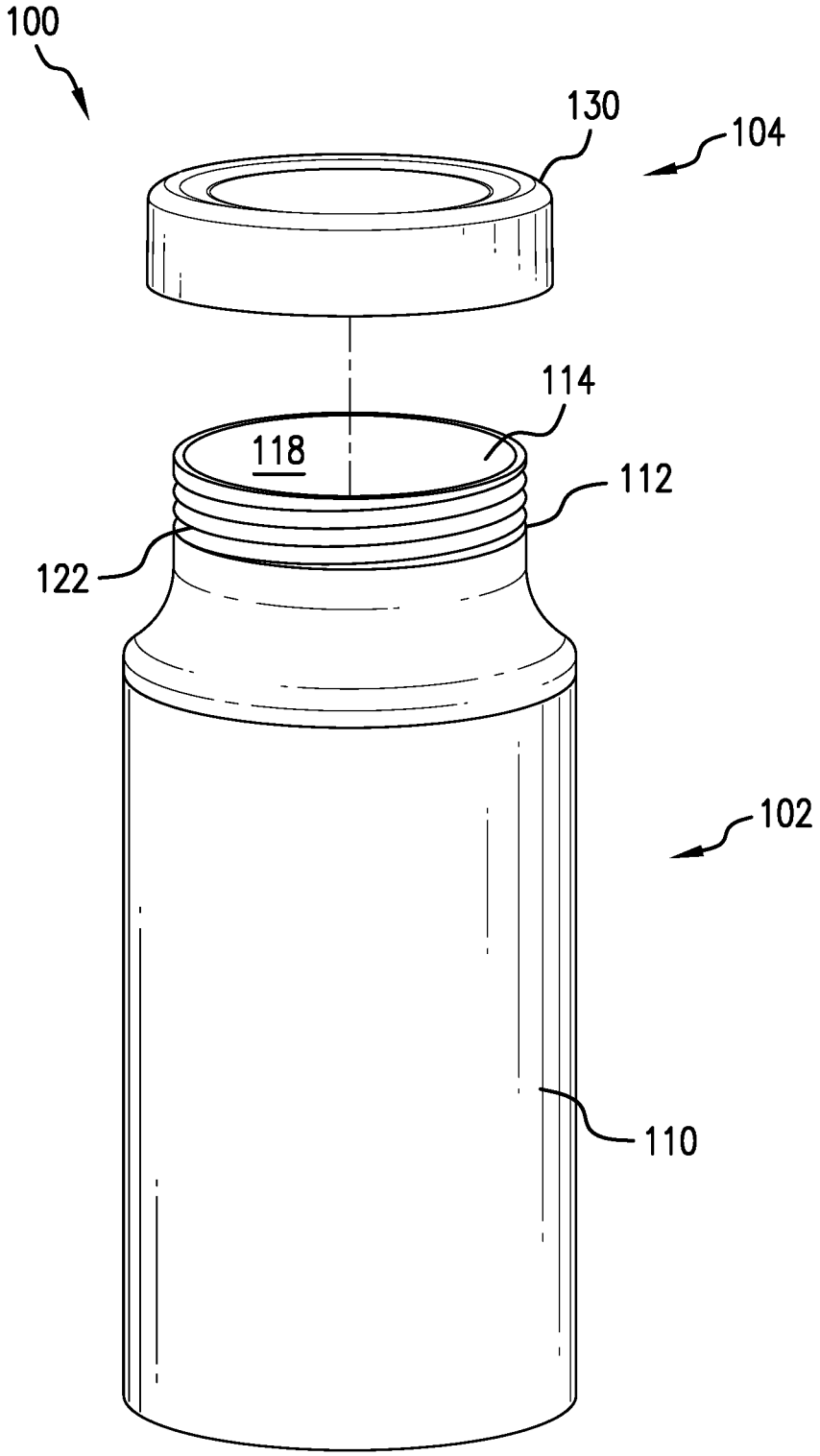
FIG. 1 is an exploded perspective view of a container assembly including a container and an exemplary container closure according to one aspect of the present disclosure.
Figure 2:
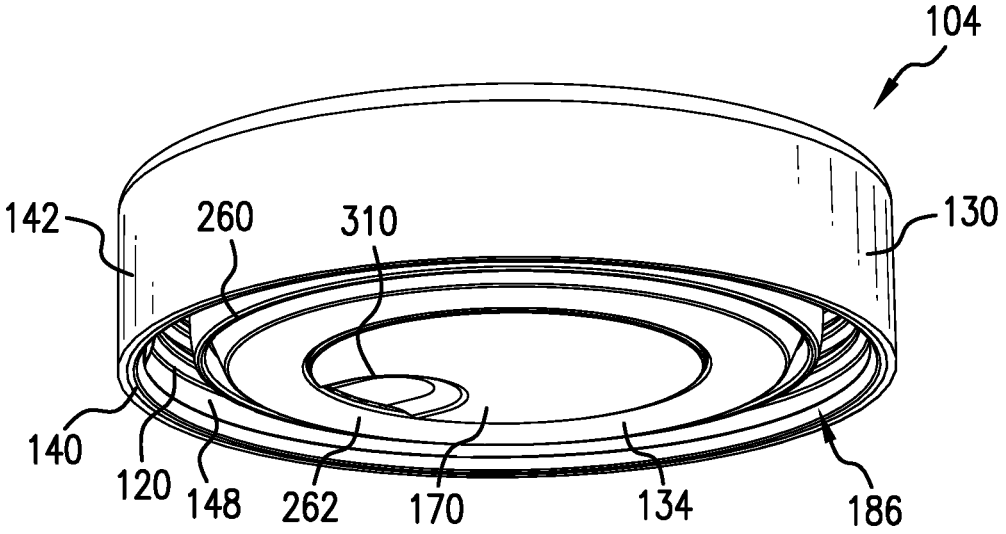
FIGS. 2 and 3 are perspective views of the closure of FIG. 1.
Figure 3:
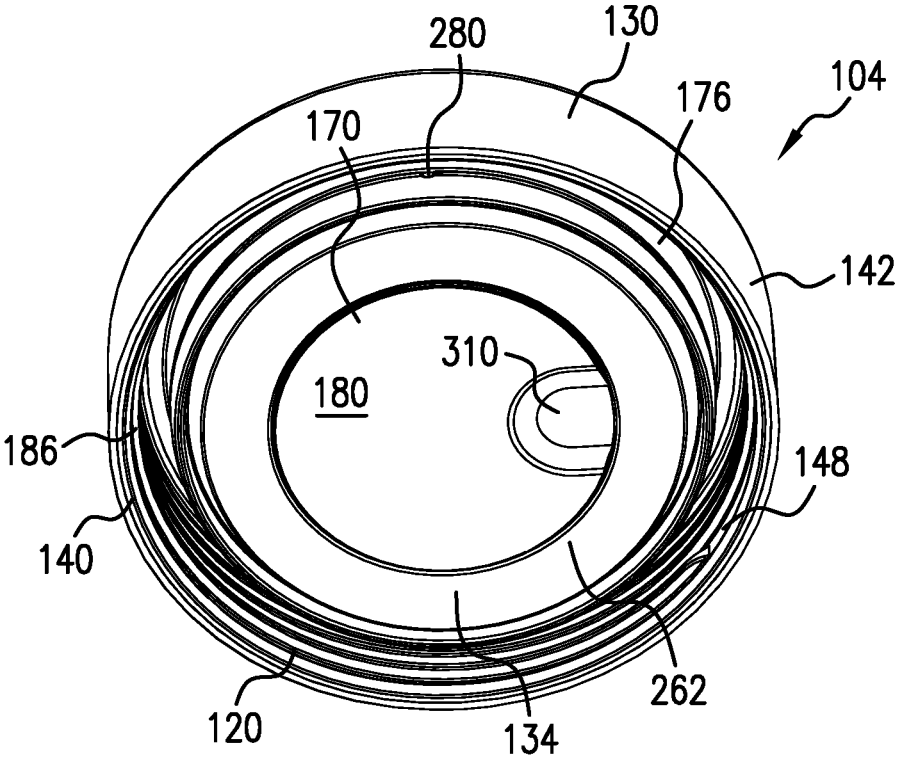

Referring now to the drawings, wherein like numerals refer to like parts throughout the several views, FIG. 1-3 illustrate a container assembly 100 comprising a container 102 and an exemplary closure 104 according to the present disclosure which is complementary to the container. The container 102 may be configured to retain a desired substance, and in particular may be configured to retain the desired substance at a temperature that is either higher or lower than an ambient temperature. In one aspect of the disclosure, the container 102 is configured to be used as a beverage container, and may correspond to or resemble a bottle, jug, growler, vessel, carafe, or similar beverage container. The container 102 may be fashioned from any material having the desired properties for a beverage container, such as a stainless steel or a plastic formulation (e.g., a thermoplastic, or a thermosetting polymer). In one aspect of the disclosure, the container 102 may incorporate a double-walled construction, with the intervening space between the walls being substantially evacuated, so that the container is a vacuum-insulated container 102. Examples of appropriate vacuum-insulated containers are commercially available from HYDRO FLASK (Bend, Oreg.).

The container 102 includes body portion 110 and a neck portion 112 having a mouth 114 that provides access to an interior 118 of the container 102. The closure 104 is transitionable between an attached and a detached configuration with respect to the container neck portion 112. The closure 104 (which may alternatively be referred to as a cap or lid) may include one or more suitable structures and components configured so as to provide a sealing closure for the mouth 114 of the container 102. By way of example, the closure 104 may include a first securing element (i.e., a first threading 120) that is complementary to a second securing element (i.e., a second threading 122) disposed on the neck portion 112. That is, the first threading may be configured to mate with the second threading, so that the closure 104 may be secured to the neck portion 112 and thereby secured to and against mouth 106. It should be appreciated that additional and/or alternative configurations of securing elements may be used to secure the closure 104 against the container 102, for example, a snap-fit or crimped rim. In such cases the closure 104 and neck portion 112 of the container 102 need not be circular. When the closure 104 is secured to the container 102, the contents of the container assembly 100 are not prone to leaking during routine handling and/or transport. However, the threaded connection does not form a gas tight seal between the closure 104 and the neck portion 112, so as to allow gas venting and pressure equalization as further described below.

Figure 4:
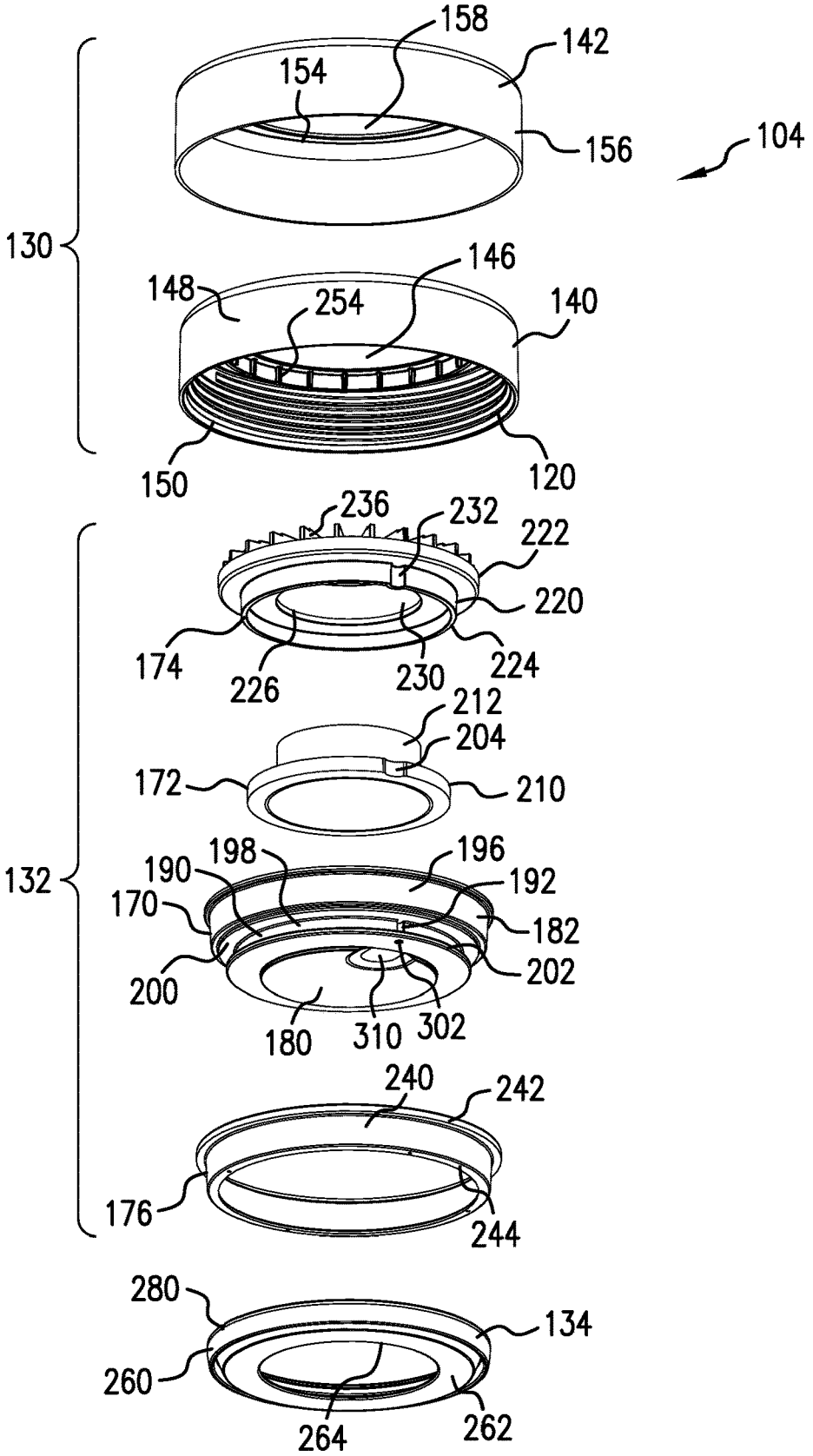
FIG. 4 is an exploded perspective view of the closure of FIG. 1.

With additional reference to FIG. 4, the exemplary closure 104 includes an outer cap assembly 130, an inner cap assembly 132 secured to the outer cap assembly, and a seal 134 secured to the inner cap assembly. The outer cap assembly 130 can comprise an outer cap 140 and, optionally, a cover member 142. The outer cap 140 includes a top wall 146 and an outer sidewall 148 extending downward from the top wall. An inner surface 150 of the outer sidewall 148 include the first threading 120. The cover member 142, which is complementary in shape to the outer cap 140, includes a top wall 154 and an outer sidewall 156. The top wall can include an opening 158 for exposing part of the top wall 146 which may be molded or inscribed to provide an aesthetic, instructional, or functional interface for a user of the container assembly 100. The cover member 142 is fixedly attached to the outer cap, for example, the cover member 142 can be overmolded onto the outer cap 140. Each of the outer cap 140 and the cover member 142 can be formed from a plastic, such as a thermoplastic, or a thermosetting polymer. The outer sidewall 156 of the cover member 142 may further include a grippable and/or manipulable surface configured to assist in attaching and/or detaching the closure 104 from the container 102.

Figure 7:
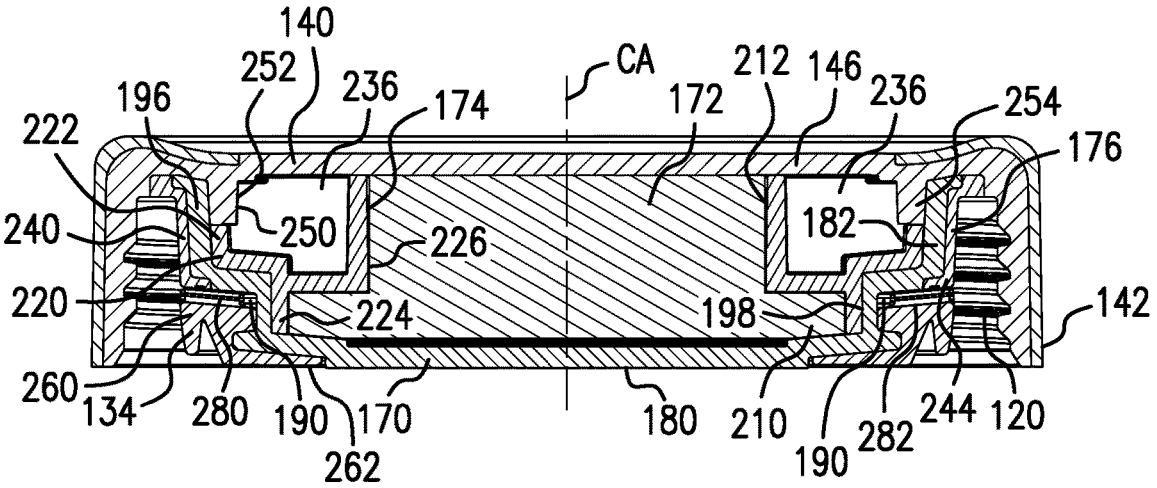
FIGS. 7-9 are cross-sectional views of the closure of FIG. 1.
Figure 8:
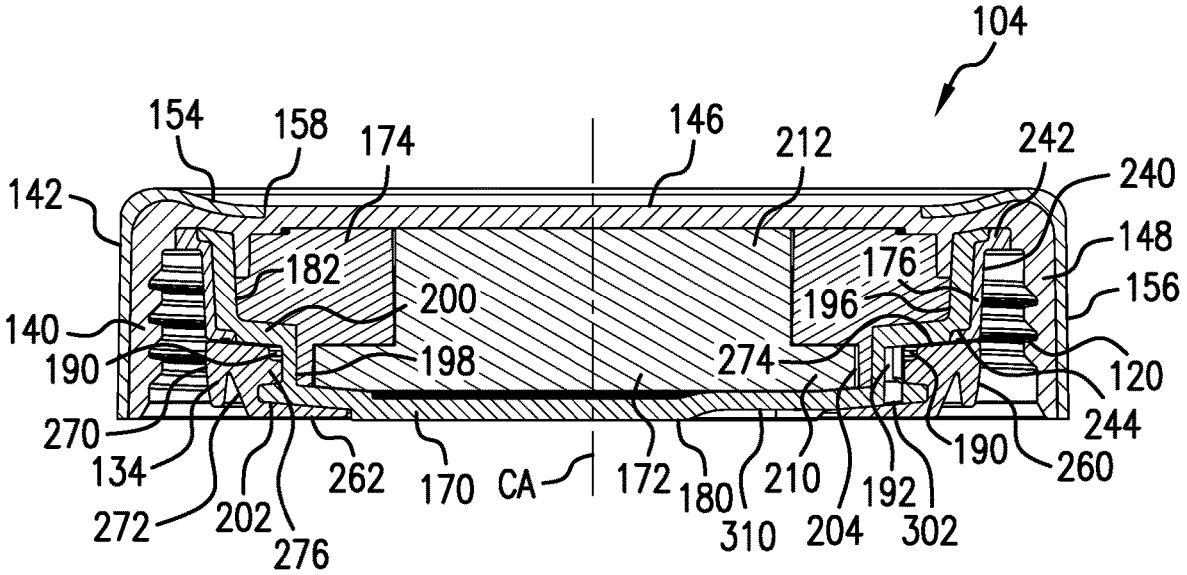
Figure 9:
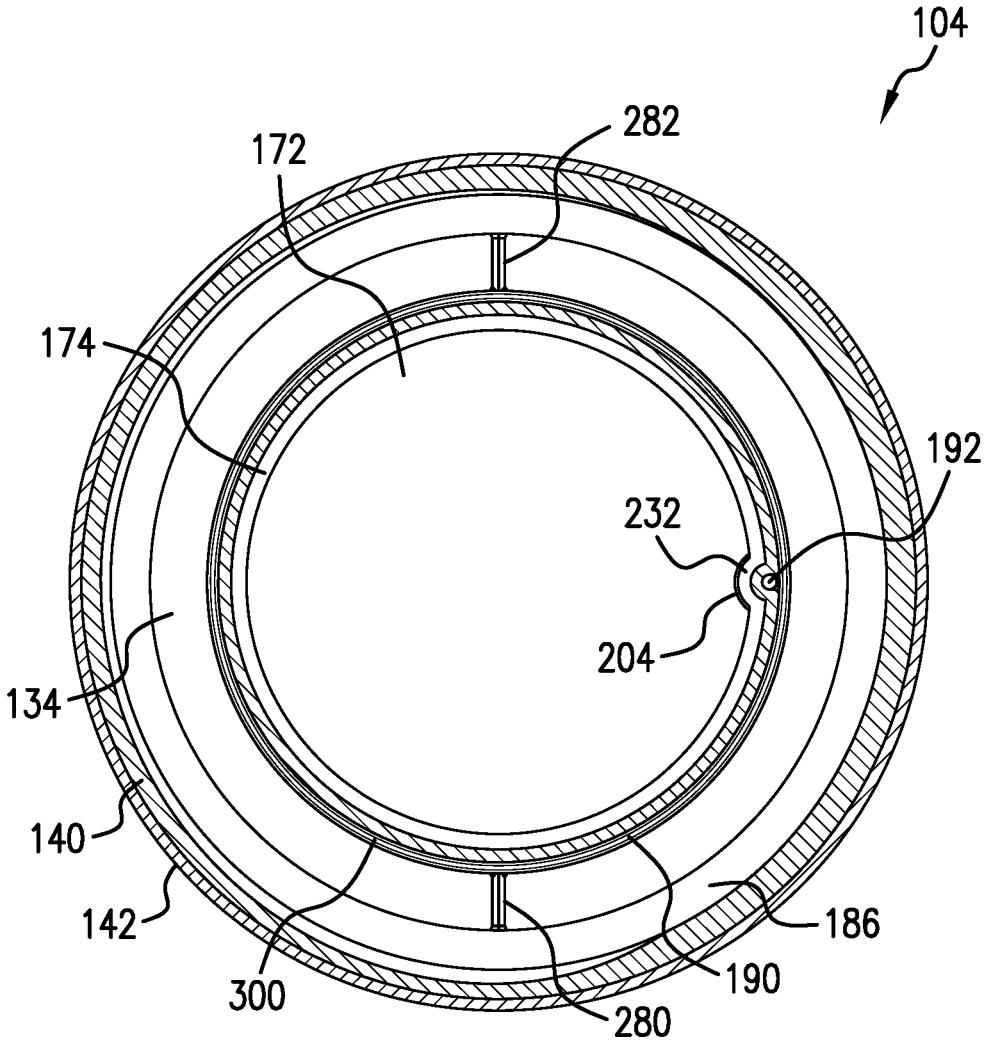

The inner cap assembly 132 is fixedly secured within the outer cap assembly 130. According to the present disclosure, the inner cap assembly 132 comprises an inner cap 170, an insulation member 172, an insert 174, and a support 176. The inner cap 170 includes a bottom wall 180 and an inner sidewall 182 extending upwardly from the bottom wall. Similar to the top wall 146, the bottom wall 180 may be molded or inscribed to provide an aesthetic, instructional, or functional interface for a user of the container assembly 100. The inner sidewall 182 is offset from the outer sidewall 156 of the outer cap 140 to define a space 186 between the outer cap 140 and the inner cap 170 for receiving the neck portion 112 of the container 102. As best depicted in FIGS. 7-9, at least one groove or channel is formed in the inner cap 170. In the present embodiment, the at least one groove includes a first groove or channel 190 and a second groove or channel 192 in communication with the first groove or channel 190. The first groove or channel 190 is formed in the inner sidewall 182 and extends circumferentially along a periphery of inner sidewall relative to a longitudinal axis CA of the closure 104 (the longitudinal axis is best depicted in FIGS. 7 and 8). The second groove or channel 192 is also formed in the inner sidewall 182 and extends axially relative to the longitudinal axis CA intersecting the first groove or channel 190. More particularly, the inner sidewall 182 includes a first upper portion 196 and a second lower portion 198. The second lower portion 198 is offset inwardly (i.e., in a radial direction relative to the longitudinal axis CA) from the first upper portion 196 so as to define a first upper ledge 200 and a second lower ledge 202. The second ledge can be slightly offset upwardly from the bottom wall 180 and forms a radial extension of the bottom wall 180 which extends past the second lower portion 198. The first groove or channel 190 is defined by the second lower portion 198 and the first and second ledges 200, 202. A section of the second lower portion 198 can be bulged inwardly to define the second groove or channel 192 (see FIG. 9).

In the depicted embodiment of FIGS. 4, 7 and 8, the insulation member 172 and the insert 174 are positioned within the inner cap 170. According to one aspect, the insulation member 172 includes a base 210 and a post 212 extending from the base. A first locating feature 204 for the second groove or channel 192 can be formed in the base 210. The insert 174 is connected to the insulation member 172. The insert 174 includes an outer sidewall 220 having an upper section 222 and a lower section 224 which are complementary in shape to the upper and lower portions 196, 198 of the inner sidewall 182 of the inner cap 170. The insert 174 further includes an inner sidewall 226 connected to the outer sidewall 220. The inner sidewall 226 together with the lower section 224 define an inner hub having a bore 230 that is complementary in shape to the insulation member 172. This allows the insert 174 to be matingly fitted or received over the insulation member 172. As shown, a second locating feature 232 for the second groove or channel 192 can be formed in the lower section 224, the second locating feature 232 received by the first locating feature 204 (see FIG. 9). The insert 174 can be further provided with a plurality of spaced reinforcing tabs 236 interconnecting the inner hub and outer sidewall 220. Further illustrated, the support 176 is received over the over the inner cap 170, particularly over the upper portion 196 of the inner sidewall 182 of the inner cap 170. In the depicted aspect, the support 176 is ring-shaped having a sidewall 240 with an upper outwardly extending ledge 242 and a lower inwardly extending ledge 244. In the assembled condition of the closure 104, the insulation member 172 is sandwiched between and covered by the top wall 146 of the outer cap 140 and the bottom wall 180 of the inner cap 170, with the base 210 in contact with the bottom wall 180 and the post 212 in contact with the top wall 146. Further, distal ends 250 of the reinforcing tabs 236 are spaced from the upper portion 196 of the inner sidewall 182 of the inner cap 170 to define offset regions 252 for locating flanges 254 depending from the top wall 146 of the outer cap 140.

Figure 5:
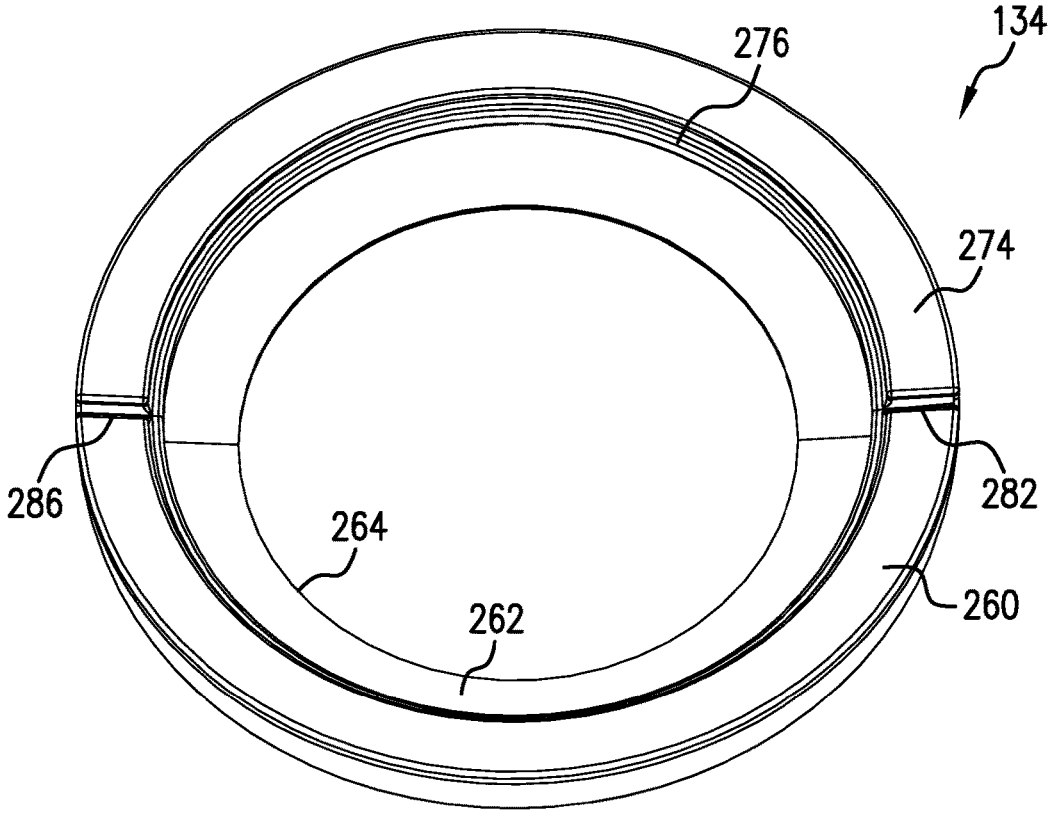
FIG. 5 is a perspective view of a seal of the closure of FIG. 1.
Figure 6:
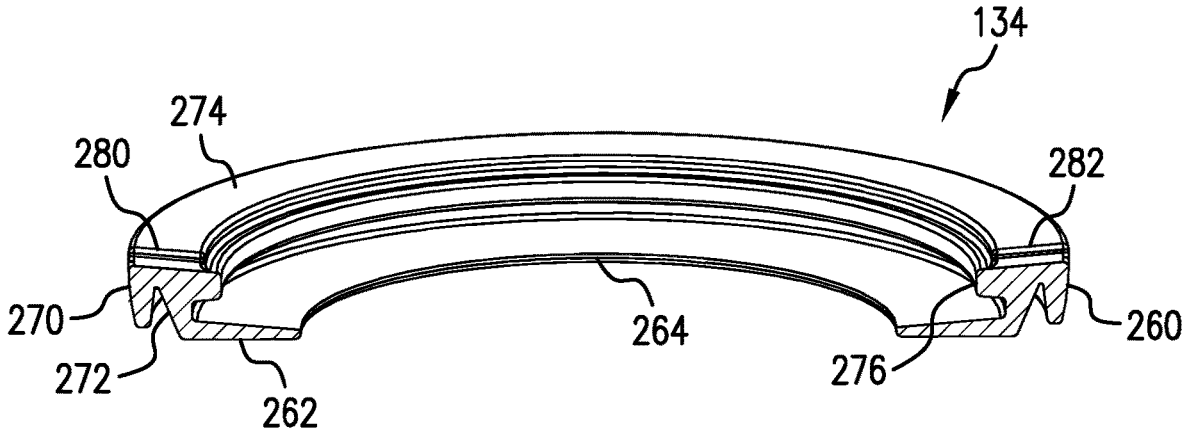
FIG. 6 is a cross-sectional view of FIG. 5

The seal 134 is provided to form a sealed connection between the neck portion 112 of the container 102 and the closure 104 when the closure is attached to (i.e., threaded onto) the neck portion. With particular reference to FIGS. 4-6, the seal 134 includes a seal sidewall 260 and a rim 262 extending inwardly from the seal sidewall, the rim 262 defining an opening 264. According to the depicted aspect, the seal sidewall 260 has an inverted U-shape in cross-section and includes an outer portion 270, an inner portion 272 and a top portion 274 interconnecting the outer and inner portions. The rim 262 extends inwardly from a lower free end of the inner portion 272. A circumferential shoulder 276 extends inwardly from a connected upper end of the inner portion 272. Further, at least one groove or channel 280 can be formed in the top portion 274, the at least one groove or channel 280 extending radially on the top portion relative to the longitudinal axis CA (see FIGS. 7 and 8). In the present disclosure, a pair of grooves or channels 280, 282 can be formed on the top portion 274, the grooves or channels 280, 282 being angularly spaced (e.g., diametrically spaced) from one another relative to the longitudinal axis. In FIGS. 7 and 8, the inner portion 272 of the seal sidewall 260 is secured to the lower portion 198 of the inner sidewall 182 of the inner cap 170. The top portion 274 is engaged against the upper ledge 200 of the lower portion 198 and the lower ledge 202 of the lower portion 198 is received between the rim 262 and the shoulder 276. Further, the rim 262 is sealingly engaged to the second lower ledge 202 of the bottom wall 180 of the inner cap 170, with the bottom wall 180 extending at least partially through the opening 264.

Each of the inner cap 170, the insert 174, and the support 176 can be formed from a plastic, such as a thermoplastic, or a thermosetting polymer. The insulation member 172 may incorporate any suitable material, structure, or device configured to reduce heat transfer between upper and lower surfaces of the insulation member. For example, the insulation member may include one or more plastics that may be the same or different than the plastics used for forming the other components of the closure 104. In addition to the incorporation of an insulating material, the insulation member 172 may include a plurality of internal voids or apertures configured so that the spaces formed by the voids decrease the thermal transfer due to conduction through the material of the insulation member 172. The seal 134 may include any material that creates or enhances an air-tight seal between the container 102 and the closure 104.

According to the present disclosure, the inner cap 170 together with the seal 134 define an air pathway 300 (see FIG. 9) in fluid communication between the space 186 between the outer and inner caps 140, 170 and an air opening 302 (see FIG. 8) formed on the bottom wall 180 of the inner cap 170 and selectively covered by the rim 262 of the seal 134. As illustrated, the air opening 302 is formed through the second lower ledge 202 of the bottom wall 180 outwardly of the lower portion 198 of the inner sidewall 182. Further depicted is a recessed portion 310 formed in the bottom wall near the air opening 302, which allows for ease of removal of the seal 134 from the inner cap 170. According to the present embodiment, the air pathway 300 is defined by the first and second grooves or channels 190, 192 formed in the inner sidewall 182 of the inner cap 170 and covered by the seal 134. The air pathway 300 can also be defined by each of the grooves or channels 280, 282 optionally formed in the top portion 274 of the seal 134 and covered by the inner cap 170. More particularly, the air pathway includes a first air pathway extending circumferentially about the longitudinal axis CA and formed by the first groove or channel 190 and the seal shoulder 276 and a second air pathway extending axially relative to the longitudinal axis CA and formed by the second groove or channel 192 and the seal shoulder 276. Due to tolerances between the inner cap 140 and the seal 134 connected thereto, ambient air is capable of flowing between the top portion 274 of the seal 134 and the first upper ledge 200 of the second lower portion 198 of the inner sidewall 182 of the inner cap 140. To facilitate this airflow, the grooves or channels 280, 282 can be provided on the top portion 274. Therefore, a third air pathway extending radial relative to the longitudinal axis CA can be formed by the top portion 274 (and optionally each of the grooves or channels 280, 282) and the first upper ledge 200 of the inner cap 170. The second air pathway intersects the first air pathway and the air opening 302, and the third air pathway intersects the first air pathway and is circumferentially spaced from the second air pathway.

As depicted in FIGS. 7 and 8, the lower end or ledge 244 of the support 176 received over the upper portion 196 of the inner sidewall 182 is both in contact with the top portion 274 of the seal 134 and can define an extension of each of the grooves or channels 280, 282. In FIGS. 7-9, the grooves or channels 280, 282 are angularly spaced from the second groove or channel 192 relative to the longitudinal axis CA. Again, the first groove or channel 190 extends circumferentially along the inner sidewall 182 of the inner cap 170, the second groove or channel 192 extends axially from the first groove or channel 190 relative to the longitudinal axis CA and terminates at the air opening 302, and the grooves or channels 280, 282 of the seal 134 extend radially from the first groove or channel 190 relative to the longitudinal axis. Further, an inner dimension of the seal sidewall 260 is less than an outer dimension of the lower portion 198 of the inner sidewall 182 so that when the seal 134 is fitted over the lower portion 198 the rim 262 is tensioned and biased against the second lower ledge 202 of the bottom wall 180 of the inner cap 170. This ensures that air opening 302 is normally closed or sealed by the rim 262 of the seal 134.

Therefore, the closure 104 is provided with the air pathway 300 allowing air flow between the interior 118 of the container 102 and the labyrinthine gap formed by the threaded connection of the closure 104 and container 102. When the container 102 is under pressurized with respect to outside ambient air pressure, a vacuum then formed within the interior 118 lifts that portion of the rim 262 covering the air opening 302 allowing ambient air to flow through the air pathway 300 and through the air opening 302 into the container. Particularly, ambient air within the space 186 flows between the threaded connection, between the top portion 274 (and optionally through each of the grooves or channels 280, 282) and the first upper ledge 200 of the inner cap 170, into and through the first groove or channel 190, into and through the second groove or channel 192, and then into and through the air opening 302. This allows for equalization of interior air pressure of the container 102 and outside ambient air pressure.

Figure 10:
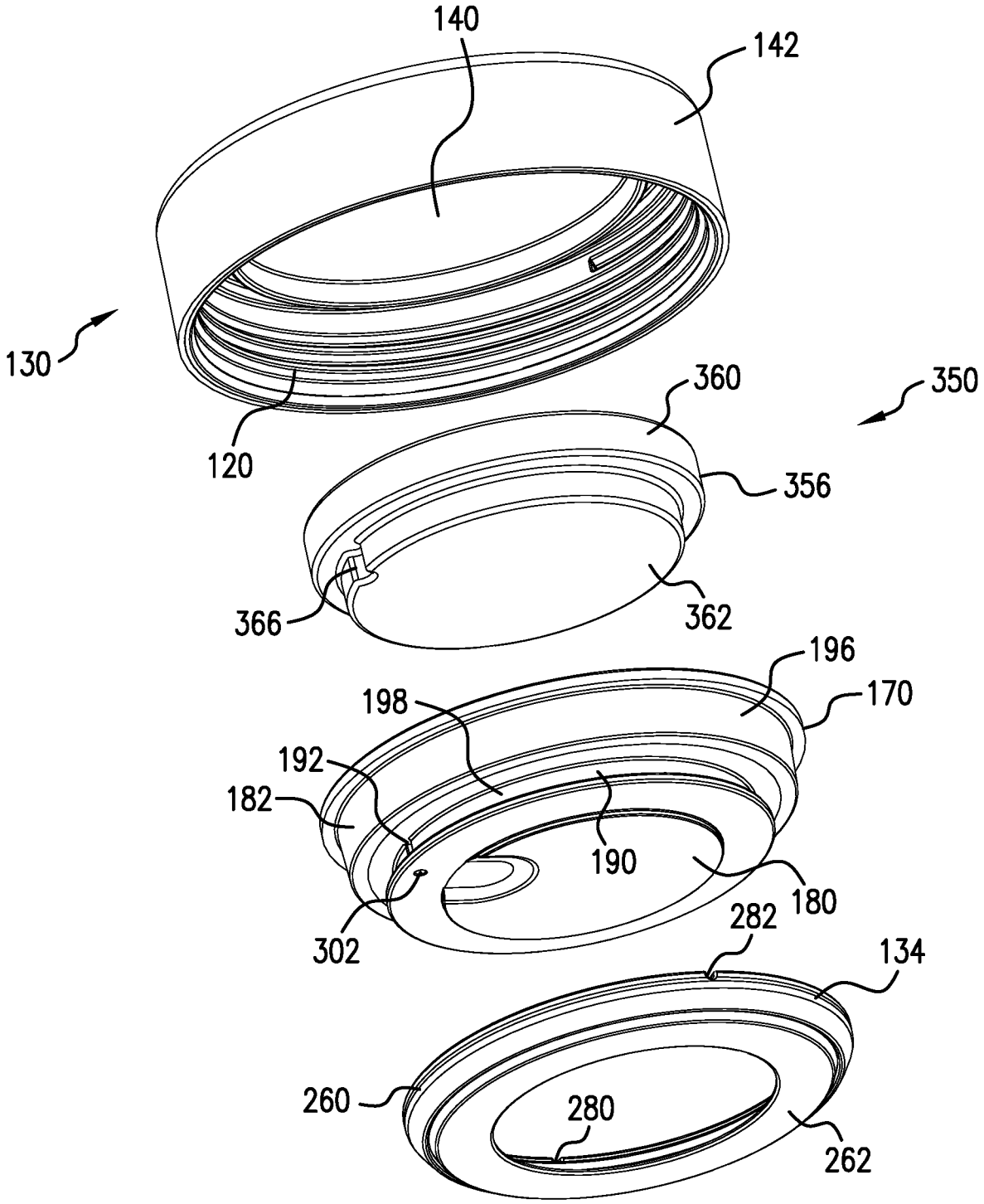
FIG. 10 is an exploded perspective view of an exemplary container closure according to another aspect of the present disclosure.
Figure 11:
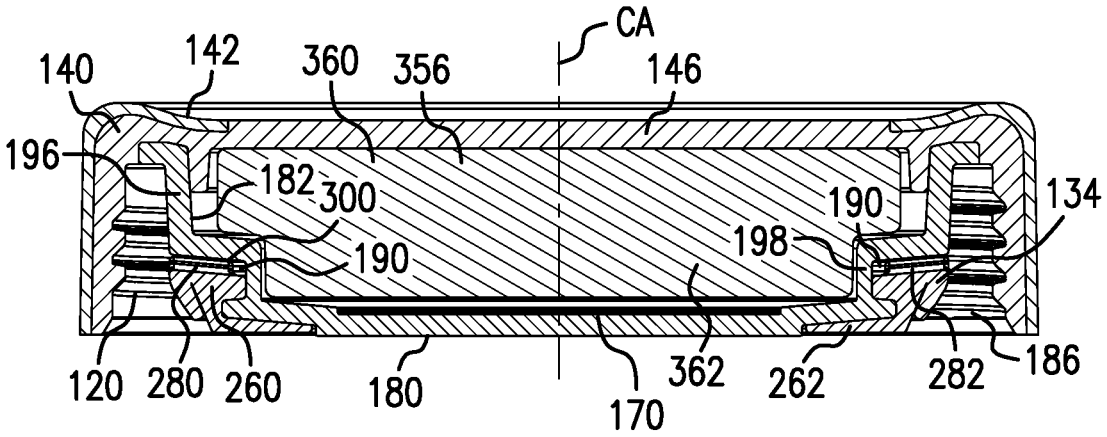
FIGS. 11 and 12 are cross-sectional views of FIG. 10.
Figure 12:
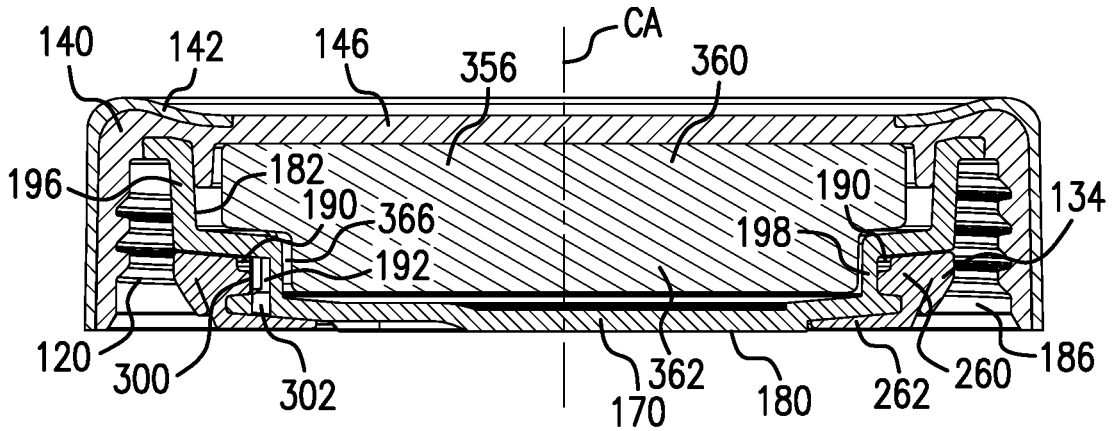

FIGS. 10-12 depict another embodiment of an exemplary closure 350 for the container assembly 100. The closure 350 includes the outer cap assembly 130 having the outer cap 140 and the cover member 142, the inner cap 170 secured to the outer cap 140, the seal 134 secured to the inner cap 170, and an insulation member 356. The insulation member 356 is positioned within the inner cap 170. According to one aspect, the insulation member 356 includes a first cylindrical part 360 having a first diameter, and a second cylindrical part 362 having a second smaller diameter positioned below the first cylindrical part. As depicted, the first and second cylindrical parts 360, 362 are complementary in shape to the respective upper and lower portions 196, 198 of the inner sidewall 182 of the inner cap 170. A locating feature 366 for the second groove or channel 192 of the inner cap 170 can be formed in the second cylindrical part 362. In the assembled condition of the closure 104, the insulation member 356 is sandwiched between and covered by the top wall 146 of the outer cap 140 and the bottom wall 180 of the inner cap 170, with the first cylindrical part 360 in contact with the top wall 146 and the second cylindrical part 362 in contact with the bottom wall 180. The insulation member 356 can be formed similar to the insulation member 172.

Figure 13:
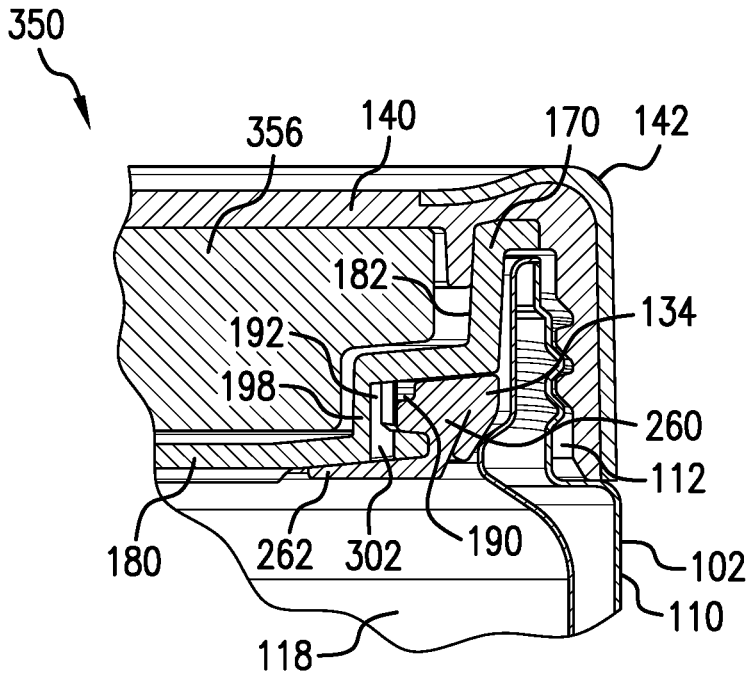
FIG. 13 is a detail cross-sectional view of a seal in a state where an interior pressure of the container is greater than or substantially equal to outside ambient air pressure.
Figure 14:
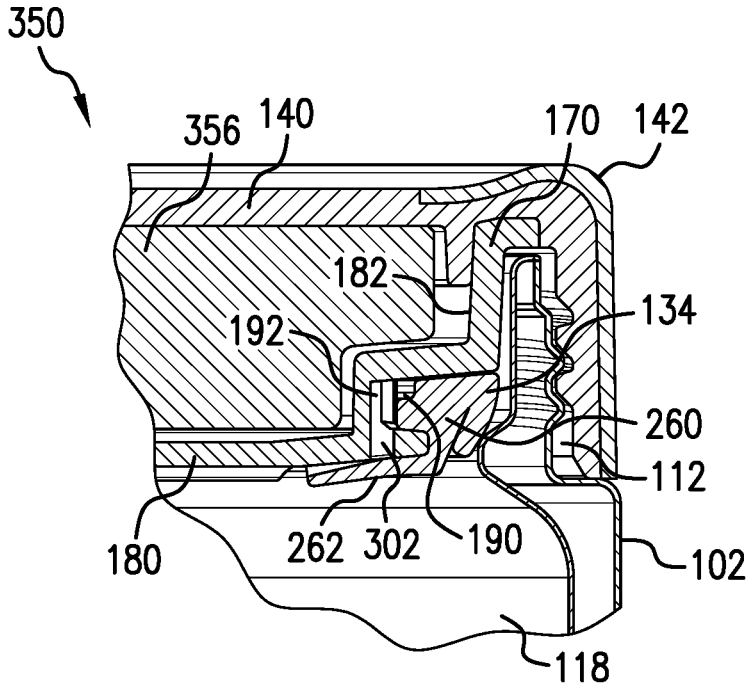
FIG. 14 is a detail cross-sectional view of the seal in a state where an interior pressure of the container is less than outside ambient air pressure.

With reference also to FIGS. 13 and 14, the seal 134, which is mounted to the lower portion 198 of the inner sidewall 182 of the inner cap 170, is provided to form a sealed connection between the neck portion 112 of the container 102 and the closure 350 when the closure is attached to (i.e., threaded onto) the neck portion. Again, the inner cap 170 together with the seal 134 define the air pathway 300 (see FIGS. 11 and 12) in fluid communication between the space 186 between the outer and inner caps 140, 170 and the air opening 302 formed on the bottom wall 180 of the inner cap 170. The air pathway 300 includes the first air pathway (i.e., the first groove or channel 190) extending circumferentially about the longitudinal axis CA, the second air pathway (i.e., the second groove or channel 192) extending axially relative to the longitudinal axis CA and intersecting the first air pathway and the air opening 302, and the third air pathway (i.e., between the seal 134 and the inner cap 170 and optionally the grooves or channels 280, 282) extending radial relative to the longitudinal axis CA, intersecting the first air pathway, and circumferentially spaced from the second air pathway. The closure 350 is adapted such that in a state where an interior pressure of the container 102 is greater than or equal to outside ambient air pressure, the air opening 302 is normally closed or sealed by the rim 262 of the seal 134 (see FIG. 13). The closure 350 is adapted such that in a state where an interior pressure of the container 102 is less than outside ambient air pressure, that portion of the rim 262 covering the air opening 302 is lifted (see FIG. 14) and ambient air flows through the air pathway 300, through the air opening 302 and into the container, again allowing for equalization of inside air pressure of the container and outside ambient air pressure.

Figure 15:
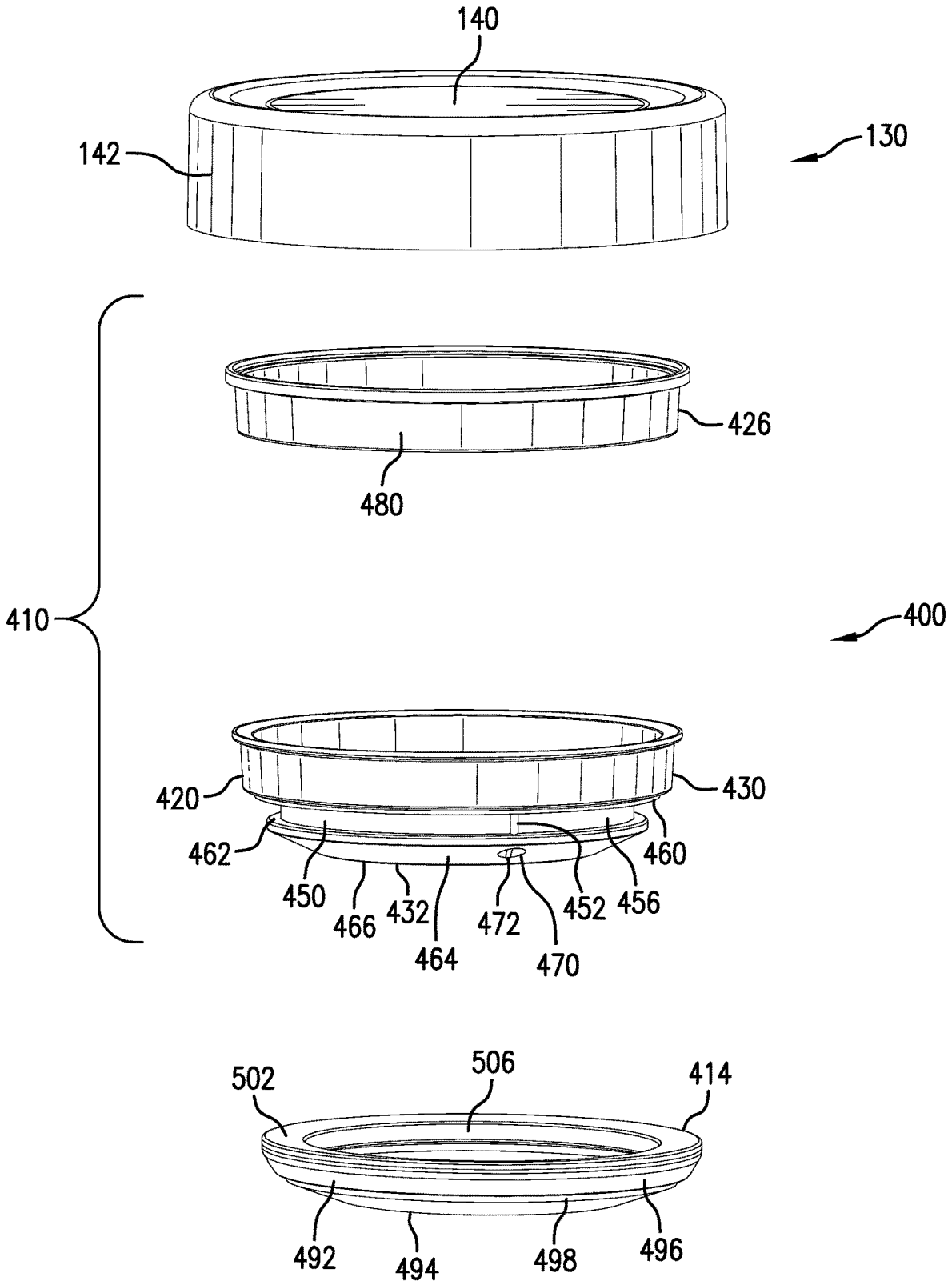
FIG. 15 is an exploded perspective view of an exemplary container closure according to another aspect of the present disclosure.
Figure 16:
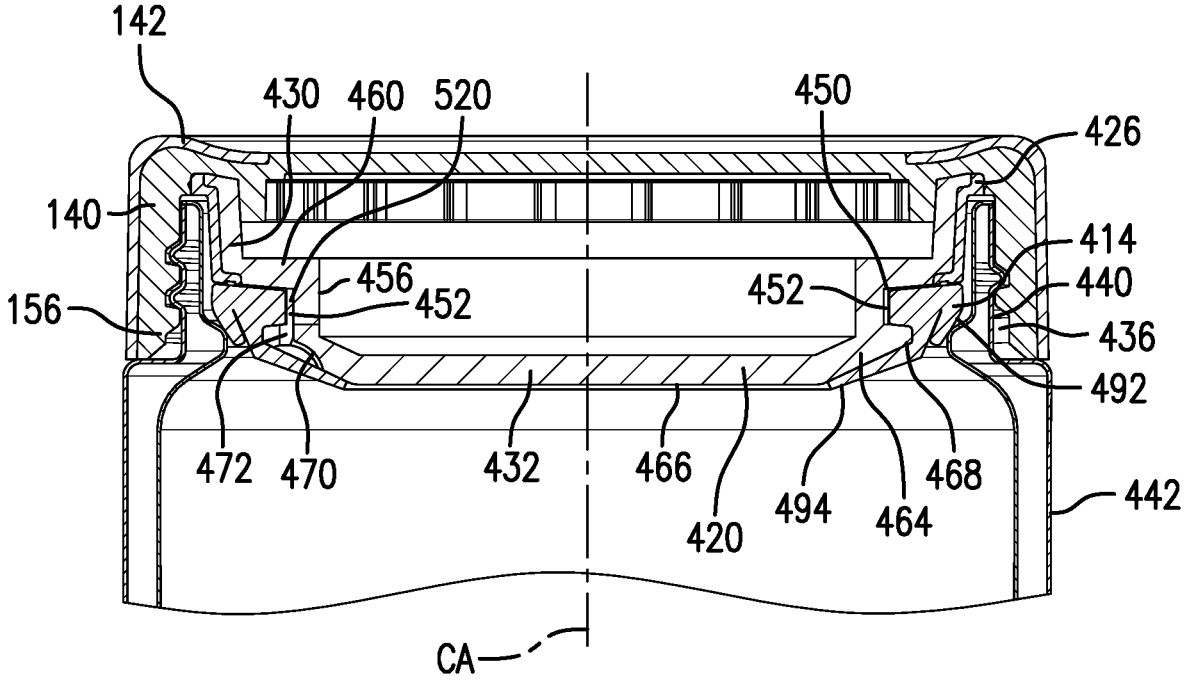
FIGS. 16 and 17 are cross-sectional views of FIG. 15.
Figure 17:
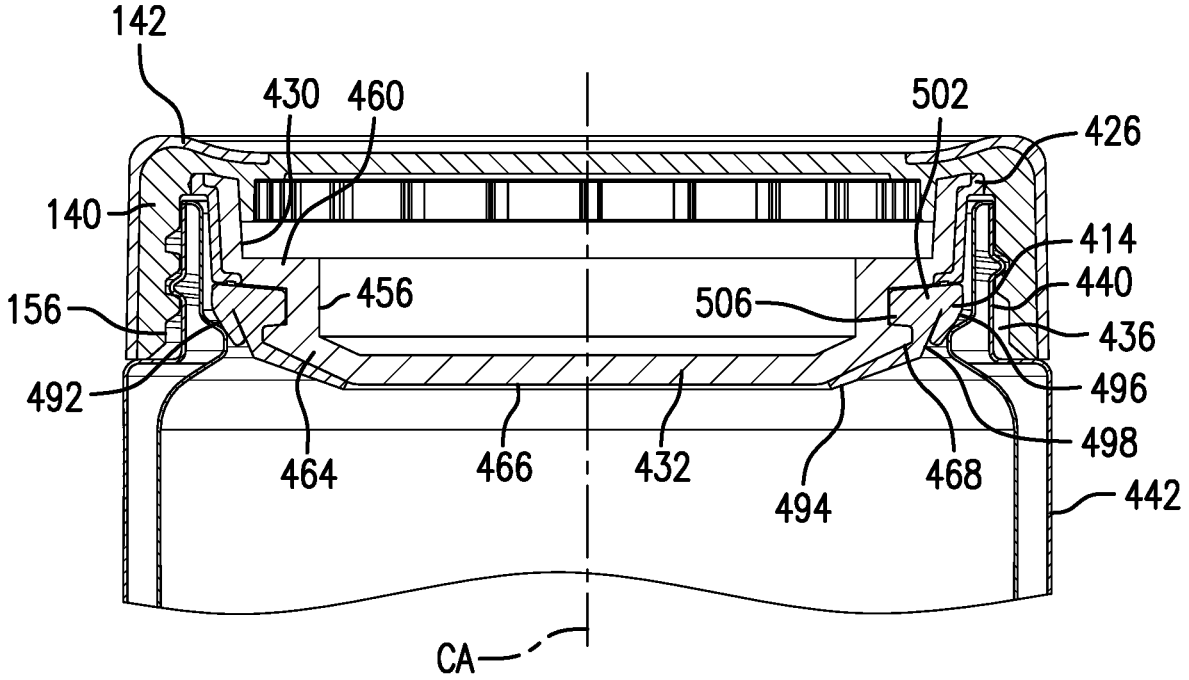

FIGS. 15-17 depict another embodiment of an exemplary closure 400 for the container assembly 100. The closure 400 includes the outer cap assembly 130 having the outer cap 140 and the cover member 142, an inner cap assembly 410 secured to the outer cap 140, and a seal 414 secured to the inner cap assembly. Similar to the previous embodiments, an insulation member (not shown) can be positioned within the inner cap assembly 410. According to the present disclosure, the inner cap assembly 410 comprises an inner cap 420 and a support 426. The inner cap 420 includes an inner sidewall 430 and a bottom member 432. The inner sidewall 430 is offset from the outer sidewall 156 of the outer cap 140 to define a space 436 between the outer cap 140 and the inner cap 420 for receiving a neck portion 440 of a container 442, which can be similar to the container 102 having a double-walled construction.

As depicted, the inner cap 420 has formed therein a first groove or channel 450 and a second groove or channel 452 in communication with the first groove or channel 450. The first groove or channel 450 is defined by an inwardly offset sidewall portion 456 (i.e., offset in an inward radial direction relative to a longitudinal axis CA of the closure 400 best depicted in FIGS. 16 and 17) formed in the inner sidewall 430 and extending circumferentially along a periphery of the inner sidewall 430 relative to the longitudinal axis CA. The sidewall portion 456 defines an upper ledge 460 and a lower ledge 462. The bottom member 432, which can be substantially saucer shaped, includes a sidewall 464 and a bottom wall 466. The lower ledge 462 extends outwardly (i.e., in an outward radial direction relative to the longitudinal axis CA) and circumferentially along a periphery the sidewall 464. Provided on the sidewall 464 of the bottom member 432 is a recessed portion 470 and an air opening 472 extends through the lower ledge 462 and into the recessed portion 470. The air opening 472 is in direct communication with the second groove or channel 452. In the depicted aspect, the support 426 is ring-shaped having a sidewall 480 dimensioned to be received over the inner sidewall 430 of the inner cap 420.

Similar to the seal 134 described above, the seal 414 includes a seal sidewall 492 and a rim 494 extending inwardly from the seal sidewall. According to the depicted aspect, the seal sidewall 492 has an inverted U-shape in cross-section and includes an outer portion 496, an inner portion 498 and a top portion 502 interconnecting the outer and inner portions (FIG. 17). The rim 494 extends inwardly from a lower free end of the inner portion 498. A circumferential shoulder 506 extends inwardly from a connected upper end of the inner portion 498. The first groove or channel 450 is further defined by the shoulder 506 of the seal 414. In FIGS. 16 and 17, the seal 414 is secured to the inner sidewall 430 of the inner cap 420 and the rim 494 is tensioned and biased against the sidewall 464 of the bottom member 422. Therefore, with the rim 494 sealingly engaged to the sidewall 464, the recessed portion 470 and the air opening 472 are normally closed or sealed by the seal 414.

Figure 18:
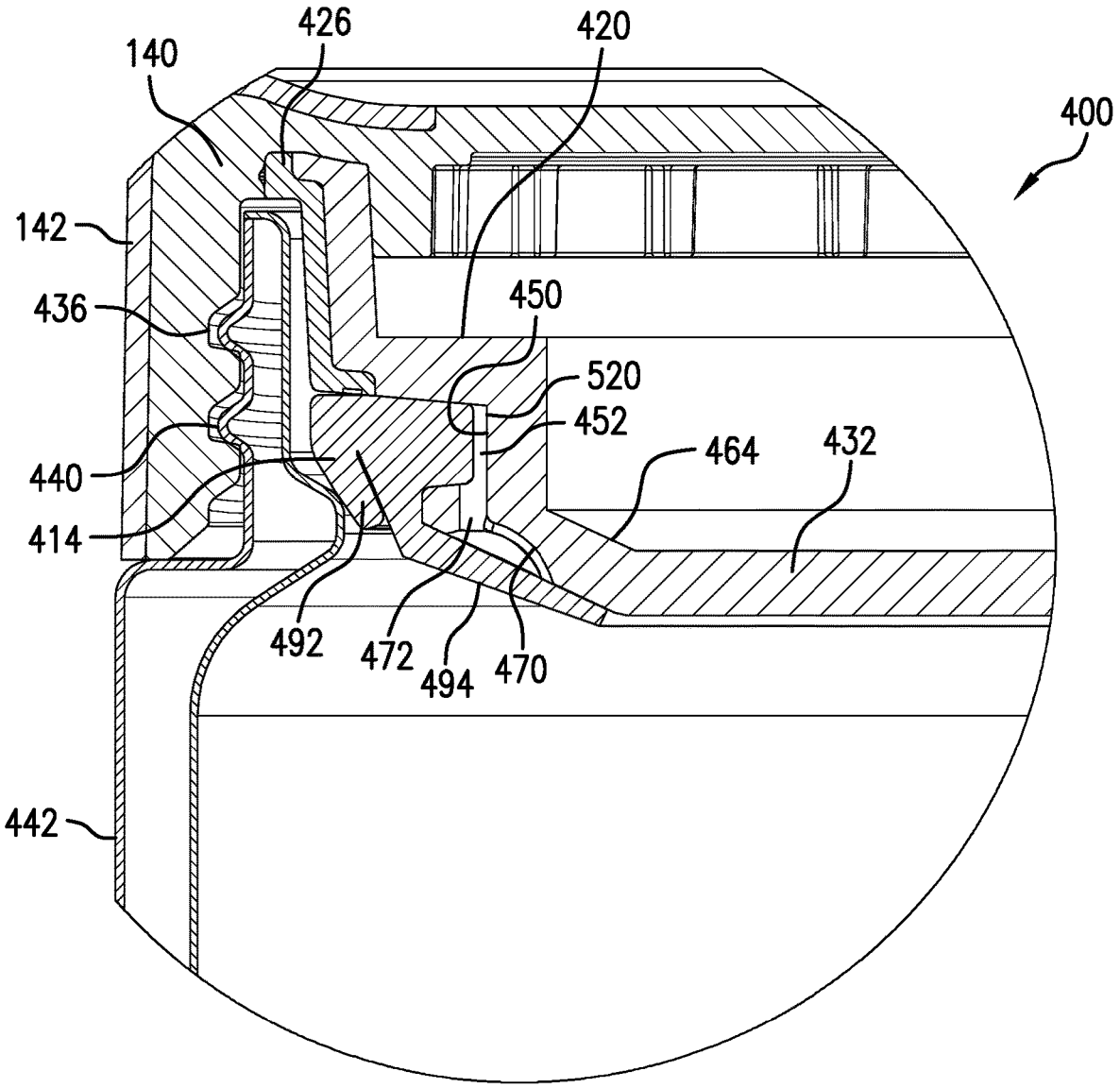
FIG. 18 is a detail cross-sectional view of a seal in a state where an interior pressure of the container is substantially equal to outside ambient air pressure.
Figure 19:
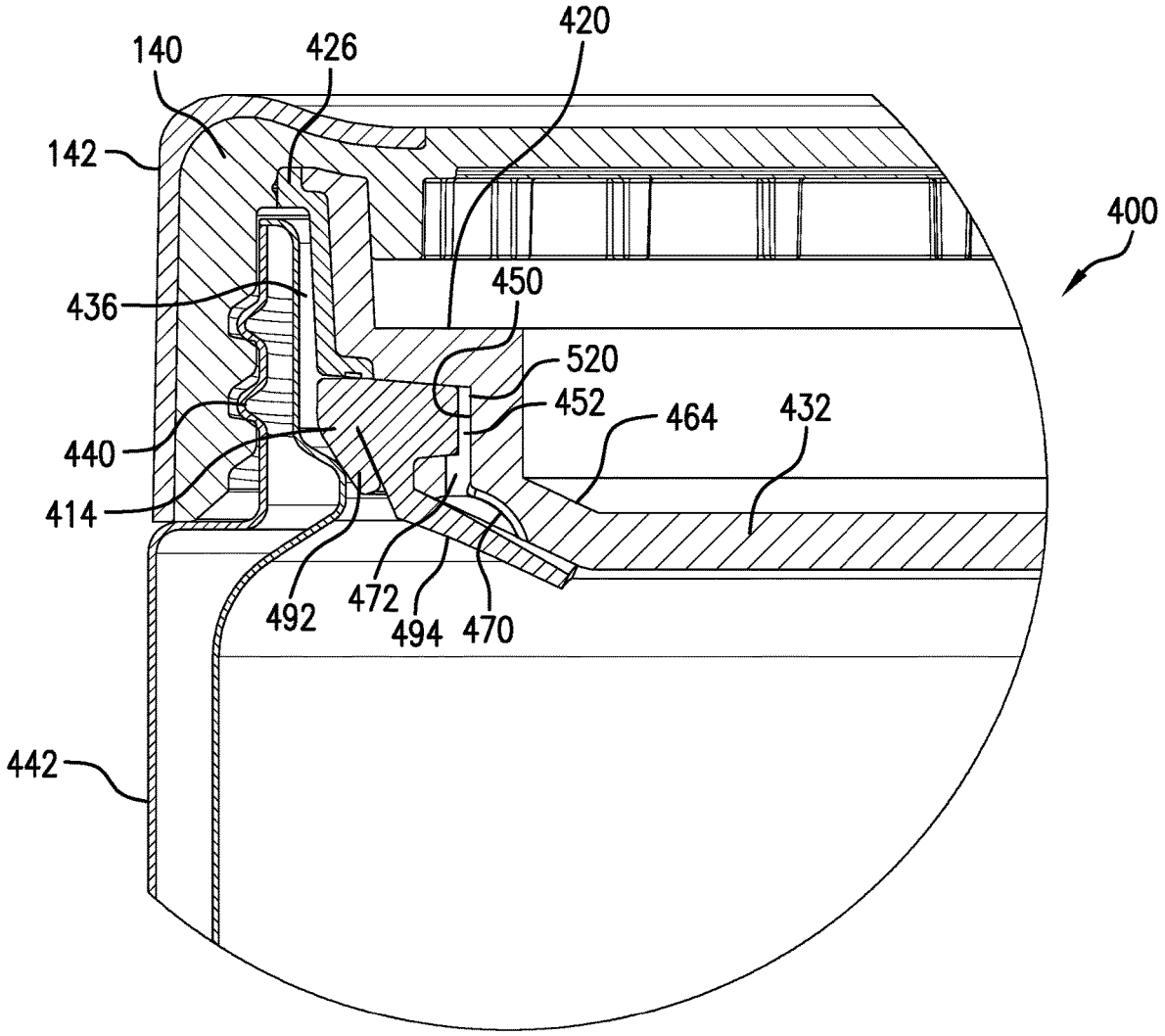
FIG. 19 is a detail cross-sectional view of the seal in a state where an interior pressure of the container is less than outside ambient air pressure.
Figure 20:
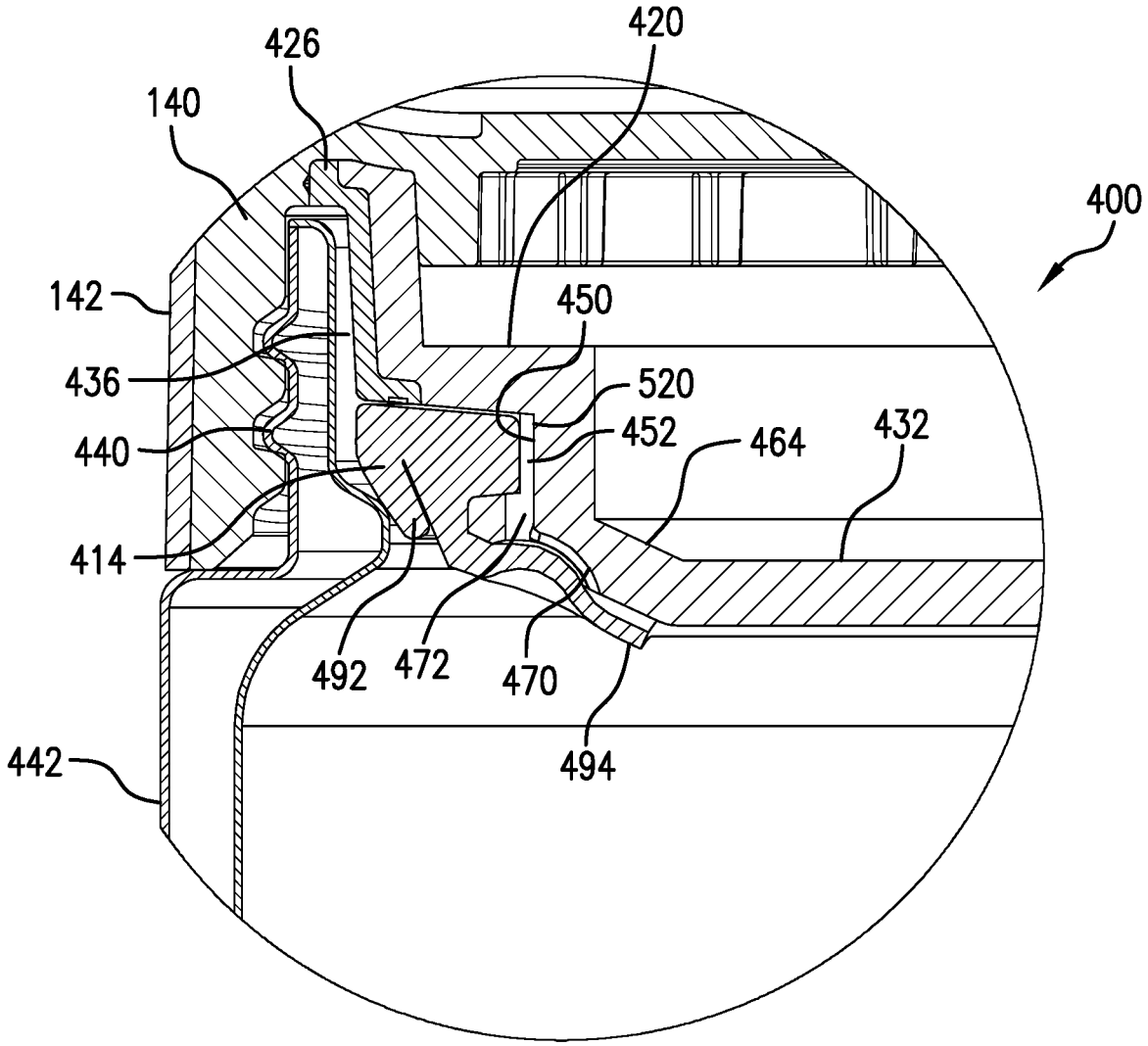
FIG. 20 is a detail cross-sectional view of the seal in a state where an interior pressure of the container is greater than outside ambient air pressure.

With reference now to FIGS. 18-20, similar to the previous embodiments, the inner cap 420 together with the seal 414 define an air pathway 520 in fluid communication between the space 436 between the outer and inner caps 140, 420 and the air opening 472 formed on the bottom member 422. The air pathway 520 includes the first air pathway (i.e., the first groove or channel 450) extending circumferentially about the longitudinal axis CA and the second air pathway (i.e., the second groove or channel 452) extending axially relative to the longitudinal axis CA and intersecting the first air pathway and the air opening 472. Similar to the previous embodiments, due to tolerances between the inner cap 420 and the seal 414 connected thereto, airflow is capable between the top portion 502 of the seal 414 and the upper ledge 460 of the inner sidewall 430 of the inner cap 420. Therefore, a third air pathway extending radial relative to the longitudinal axis CA can be formed by the top portion 502 and the upper ledge 460 of the inner cap 420. The third air pathway intersects the first air pathway and the second air pathway. FIG. 18 is a detail cross-sectional view of the seal 414 in a state where an interior pressure of the container 442 is substantially equal to outside ambient air pressure. As shown, the seal sidewall 492 is sealingly engaged to the neck portion 440 of the container 442 and the rim 494 is sealingly engaged to the sidewall 464 of the bottom member 422. The recessed portion 470 and, in turn, the air opening 472, is covered and sealed by the rim 494. FIG. 19 is a detail cross-sectional view of the seal 414 in a state where a predetermined interior pressure of the container 442 is less than outside ambient air pressure. In this state, the vacuum formed within the container lifts that portion of the rim 494 covering the recessed portion 470 and the air opening 472. This allows ambient air to flow through the above described air pathway 520, through the air opening 472 and into the container, allowing for equalization of inside air pressure of the container and outside ambient air pressure. Particularly, after the rim 494 is lifted away from the bottom member 422, ambient air within the space 436 flows between the threaded connection, between the upper portion 502 of the seal 414 of the upper edge 460 of the inner cap 420, into and through the first groove or channel 450, into and through the second groove or channel 452, and into and through the air opening 472 to the interior of the container. FIG. 20 is a detail cross-sectional view of the seal 414 in a state where a predetermined interior pressure of the container 442 is greater than outside ambient air pressure. In this state, that portion of the rim 494 covering the recessed portion 470 is at least partially deformed into the recessed portion, which, in turn, lifts that portion of the of the rim 494 away from the bottom member 422. This allows air from within the container to flow out the air opening 472, through the above described air pathway 520, into the space 436, and from there to ambient, again allowing for equalization of inside air pressure of the container and outside ambient air pressure.

It will be appreciated that the above-disclosed features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A container closure, comprising:

an outer cap including a top wall and an outer sidewall extending downward from the top wall;

an inner cap secured within the outer cap, the inner cap including a bottom wall and an inner sidewall extending upwardly from the bottom wall, the inner sidewall is offset from the outer sidewall to define a space between the outer cap and the inner cap for receiving an associated neck portion of an associated container;

a seal secured to the inner cap, the seal including a seal sidewall and a rim extending inwardly from the seal sidewall, the seal sidewall sealingly engaging the inner sidewall and the rim sealingly overlapping the bottom wall, wherein the inner cap together with the seal define an air pathway therebetween that fluidly connects the space between the outer and inner caps and an air opening formed on the bottom wall of the inner cap and selectively covered by the rim.

2. The container closure of claim 1, wherein the air pathway is at least partially defined by at least one groove formed in the inner cap and covered by the seal.

3. The container closure of claim 2, wherein the at least one groove is a first groove formed in and along a periphery of the inner sidewall and a second groove formed in the inner sidewall and intersecting the first groove.

4. The container closure of claim 3, wherein the air pathway is at least partially defined by at least one channel formed in the seal and covered by the inner cap.

5. The container closure of claim 4, wherein the container closure defines a longitudinal axis, and the second groove is angularly spaced from the at least one channel relative to the longitudinal axis.

6. The container closure of claim 4, wherein the container closure defines a longitudinal axis, the at least one channel is a first channel and a second channel circumferentially spaced from the first channel relative to the longitudinal axis, and one of the first channel and the second channel intersects the second groove.

7. The container closure of claim 2, wherein the at least one groove separates the inner sidewall into an upper portion and a lower portion, and an inner dimension of the seal is less than an outer dimension of the lower portion so that when the seal is fitted over the lower portion the rim is tensioned and biased against the bottom wall.

8. The container closure of claim 1, wherein the container closure defines a longitudinal axis, the air pathway is defined by a first channel extending circumferentially along the inner cap and a second channel extending axially from the first channel relative to the longitudinal axis.

9. The container closure of claim 8, wherein the first channel extends circumferentially along the inner sidewall and the second channel fluidly connects the first channel and the air opening in the bottom wall.

10. The container closure of claim 1, wherein the bottom wall includes a recessed portion and the air opening is located in the recessed portion.

11. The container closure of claim 1, in combination with a container, the container including a neck portion, and the container closure transitionable between an attached and a detached configuration with respect to the container neck portion, wherein the rim is configured to be lifted away from the bottom wall when a predetermined interior air pressure of the container is less than outside ambient air pressure, allowing ambient air to flow through the air pathway and through the air opening into the container to equalize interior air pressure of the container and outside ambient air pressure.

12. The combination of claim 11, wherein the bottom wall includes a recessed portion and the air opening is located in the recessed portion, and the rim is configured to be at least partially deformed into the recessed portion when the predetermined interior air pressure of the container is greater than outside ambient air pressure, allowing inside air to flow out through the air opening and through the air pathway to ambient to equalize interior air pressure of the container and outside ambient air pressure.

13. The container closure of claim 1, in combination with a container, the container including a neck portion, and the container closure transitionable between an attached and a detached configuration with respect to the container neck portion, wherein the rim is configured to be lifted away from the bottom wall when a predetermined interior air pressure of the container is greater than outside ambient air pressure, allowing inside air to flow out through the air opening and through the air pathway to ambient to equalize interior air pressure of the container and outside ambient air pressure.

14. The combination of claim 13, wherein the bottom wall includes a recessed portion and the air opening is located in the recessed portion, and the rim is configured to be at least partially deformed into the recessed portion when the predetermined interior air pressure of the container is greater than outside ambient air pressure.

15. A container assembly, comprising:

a container including a body portion and a neck portion having a mouth; and a container closure transitionable between an attached and a detached configuration with respect to the container neck portion, wherein the container closure includes:

an outer cap including a top wall and an outer sidewall extending downward from the top wall;

an inner cap secured within the outer cap, the inner cap including a bottom wall and an inner sidewall extending upwardly from the bottom wall, the inner sidewall is offset from the outer sidewall to define a space between the outer cap and the inner cap for receiving the neck portion of the container;

a seal secured to the inner cap and forming a sealed connection between the neck portion and the closure when the closure is attached to the neck portion, the seal including a seal sidewall and a rim extending inwardly from the seal sidewall, the rim sealingly engaging the bottom wall, wherein the inner cap together with the seal define an air pathway therebetween that is in fluid communication between the space between the outer and inner caps and an air opening formed on the bottom wall of the inner cap and selectively covered by the rim, wherein the rim is configured to be lifted away from the bottom wall when a vacuum is formed within the container, allowing ambient air to flow through the air pathway and then through the air opening into the container to equalize interior air pressure of the container and outside ambient air pressure, wherein the bottom wall includes a recessed portion and the air opening is located in the recessed portion, wherein the rim is configured to be at least partially deformed into the recessed portion when a predetermined interior air pressure of the container is greater than outside ambient air pressure, deformation of the rim lifting the rim away from the bottom wall, allowing inside air to flow out through the air opening and then through the air pathway to ambient to equalize interior air pressure of the container and outside ambient air pressure.

16. The container of claim 15, wherein the air pathway is at least partially defined by a first groove formed in and along a periphery of the inner sidewall and a second groove formed in the inner sidewall and intersecting the first groove and the air opening, the seal covering each of the first groove and the second groove.

17. The container of claim 16, wherein the air pathway is at least partially defined by at least one channel formed in the seal and covered by the inner cap, the at least one channel intersecting the first groove.

18. The container of claim 15, wherein the container defines a longitudinal axis, and the air pathway includes a first air pathway extending circumferentially about the longitudinal axis and a second air pathway extending axially relative to the longitudinal axis and intersecting the first air pathway and the air opening.

* * * * *